US005874599A

United States Patent [19]

Harris et al.

[11] Patent Number: 5,874,599

[45] Date of Patent: Feb. 23, 1999

[54] DRY FRACTIONATION OF FAT MOLECULES IN A PSEUDO-STEADY STATE

[75] Inventors: John Bernard Harris, Bedford, Great Britain; Cornelius Nicholaas M. Keulemans, SV Rozenburg, Netherlands; Leslie Alan Milton, RB Voorburg, Netherlands; Erwin J G Roest, Wormer, Netherlands

[73] Assignee: Loders Croklaan B.V., Wormerveer, Netherlands

[21] Appl. No.: 793,429

[22] PCT Filed: Jul. 28, 1995

[86] PCT No.: PCT/EP95/03035

§ 371 Date: Jun. 11, 1997

§ 102(e) Date: Jun. 11, 1997

[87] PCT Pub. No.: WO96/05279

PCT Pub. Date: Feb. 22, 1996

[30] Foreign Application Priority Data

Aug. 17, 1994 [EP] European Pat. Off. ..... 94306056

[51] Int. Cl.[6] ..... C11B 3/00

[52] U.S. Cl. ..... 554/211

[58] Field of Search ..... 554/211

[56] References Cited

U.S. PATENT DOCUMENTS 4,161,484 7/1979 Hendrikus .

FOREIGN PATENT DOCUMENTS 262 113 3/1988 European Pat. Off. .
535 475 4/1993 European Pat. Off. .
2 180 253 3/1987 United Kingdom .
2 270 925 3/1994 United Kingdom .

OTHER PUBLICATIONS

Whittam et al: "Etude microscopique dy vieillissement de la tripalmitine", Revue Francaise Des Corps Gras, vol. 21, No. 11, 1974 Paris Fr., pp. 605–610.

*Primary Examiner*—Gary Geist
*Assistant Examiner*—Deborah D. Carr
*Attorney, Agent, or Firm*—Pillsbury Madison & Sutro LLP

[57] ABSTRACT

A pseudo-steady state fractionation of a polymorhic fat, resulting in a product which is in a kinetically stable crystal form is performed in a way that a σ-value is maintained below 0.5, wherein $$\sigma = 1 - \frac{S_c}{S_E}$$

$S_c$ being: the percentage solids in crystalliser at crystallisation temperature $S_E$ being: the percentage solids after stabilisation for 48 hrs at exit temperature of crystalliser.

14 Claims, No Drawings

DRY FRACTIONATION OF FAT MOLECULES IN A PSEUDO-STEADY STATE

This application is the national phase of international application PCT/EP95/03035 filed Jul. 28, 1995 which designated the U.S.

BACKGROUND OF THE INVENTION

The dry fractionation processes for the fractionation of fats disclosed in the prior art are all based on the use of a system comprising a heat exchanger for the starting oil, a crystalliser for the oil obtained after the heat exchange and a filter press wherein crystals are separated from the liquid components.

Because of the conditions applied during these known dry fractionation processes the products contain large amounts of kinetically unstable crystals. Moreover those known processes require high levels of undercooling, which make the processes difficult to control. As a result of above the products are not optimal for filtering, which results in poor yields and poor separation efficiency.

It would be very beneficial if a dry fractionation could be found, that does not have above drawbacks.

SUMMARY OF THE INVENTION

We have conducted a study in order to find out whether such a process could be developed. This study resulted in an economically feasible (semi-)continuous dry fractionation process for the crystallisation of polymorphic fat molecules. Therefore, our invention concerns a process for the crystallisation of polymorphic fat molecules in a pseudo-steady state process, wherein the crystallisation is performed in a dry fractionation system in such a way that the crystal form of the product is a kinetically-stable crystal form, while during the crystallisation a σ-value is maintained below 0.5, preferably below 0.3, more preferably between 0.001 and 0.2, during a period of at least 12 hrs, wherein:

$$\sigma = 1 - \frac{S_c}{S_E}$$

$S_c$ being : percentage of solids in crystalliser at crystallisation temperature; $S_E$ being : percentage of solids after stabilisation for 48 hours at exit temperature of the crystalliser.

So in order to measure $S_E$ a sample is taken from the crystalliser at time is 0 hrs and kept for 48 hrs at final crystalliser temperature without stirring. At time t=48 hours the percentage of solids in the sample is measured by NMR-pulse. For the measurement of $S_C$ the solids are measured in the crystalliser immediately before material is taken out for pressing. Time t=0 hrs is taken as the point in time where for the first time material is taken from the crystalliser for pressing. If $S_C$ and $S_E$ are very close it can be, that the values obtained (due to experimental inaccuracy) are such, that $S_E < S_C$, so that σ is negative.

$$\sigma = 1 - \frac{S_c}{S_E}$$

DESCRIPTION OF PREFERRED EMBODIMENTS

Above process according to our invention is conducted in such a way, that the system is always close to its equilibrium, therefore high levels of the more kinetically stable crystal form are obtained. The process is best achieved by performing a very slow stirring during the crystallisation step. Consequently the crystals are easier to filter and an optimal production in high yields and high separation efficiency can be achieved.

Kinetically stable crystal form being defined as any crystal form that at the process-conditions at steady-state does not change substantially during the process and thus may include the thermodynamically stable crystalform.

Another advantage is obtained by applying our novel process on polymorphic fats. The fats obtained according to our novel process do contain more of the stable β-crystals, than the products of the conventional processes (which contain far more $\beta^1$-crystals) . Polymorphic fats being defined as fats, that can crystallise in different crystal-forms.

The above-mentioned process can be run as a pseudo-steady state process for more than 24 hours, preferably for more than 48 hours, while even a period of more than 60 hours can be achieved.

For the above-mentioned process to be carried out, a minimum residence time (τ) of the fat in the crystalliser should be maintained. Suitable residence times are τ of more than 1 hour, preferably more than 4 hours and more preferably more than 12 hours, residence time (τ) being defined as:

$$\tau = \frac{\text{Volume of crystalliser}}{\text{Average flow rate}}$$

Average flow rate being defined as: total volume of material taken from the crystalliser during one experiment divided by the total time of the experiment (starting from t=0)

For the above-mentioned a-values to be achieved, it is suitable to apply a crystalliser whose volume represents more than 2 times, preferably more than 3 times, more preferably more than 5 times the filling (volume) of the separator applied. Very suitably, crystallisers are applied having a volume of more than 10 $m^3$, preferably more than 30 $m^3$, more preferably more than 60 $m^3$.

Using the above-mentioned volumes for crystalliser and separator (=filter press) causes (considering the duration of the process) only a limited volume of pre-crystallised oil to be conveyed from the crystalliser to the filter press. This increases the available time for residence of the oil in the crystalliser, thus making it possible, to come very close to the equilibrium-conditions.

Because of the above-mentioned condition, the fat separated as product will be in a kinetically-stable crystal form. This means that, when a polymorphic fat of the SOS-type triglycerides is applied, in this fat more than 25%, preferably more than 45%, more preferably more than 60% of the solid fat, can be present in the β-polymorphic crystal form.

Examples of fats that can be suitably applied are fats selected from the group consisting of palm oil, palm oil olein, shea, high-oleic sunflower oil, palm oil stearin, high stearic bean oil, hardened vegetable fat, enzymically interesterified fats, chemically interesterified fats or mixtures thereof.

A main advantage of the process according to the invention is that it can be controlled by selecting and adjusting the flow rate, shear rate and temperature only.

Typical conditions that can be applied for the dry fractionation of palm oil olein are, e.g.:

temperature of starting oil:50° C.

temperature of oil after heat exchange : <20° C.

temperature of oil at the end of crystalliser : <15° C.

temperature of oil in the filter press <15 ° C.

flow rate in heat exchanger 6 $m^3$/hr flow rate in at least one of the crystallisers 3 $m^3$/hr volume of crystalliser 54 $m^3$ volume of filter press 4 $m^3$ (filling volume: 5–7 $m^3$) So: $\tau$=18 hours $S_c$ applied: 20–30%

$S_E$ applied: 25–35%

So: $\sigma$= remains between 0.14 and 0.25

Using the above-mentioned conditions, a standard palm oil olein can be split into a top fraction (yield 50%) and into a bottom fraction (yield 50%).

Such a process can be run for 60–70 hours without giving rise to problems of encrustration, slurry stability, polymorphic form or viscosity.

EXAMPLE 1

A dry-fractionated palm oil olein was used as starting material. This oil had an I.V.=55.9; a solid fat content (NMR-pulse) at 20 ° C. of 5.0 and contained 35.9 wt. % of SOS-triglycerides. (S=saturated $C_{16}$ +$C_{18}$-fatty acids: 0=oleic acid).

The oil was fractionated by bringing into a crystalliser with a volume of 10 1., which was stirred slowly (10 rpm). The oil was cooled, using the following regime:

1 hr at 50° C.

from 50° to 31° C. in 9 hrs 1 hr at 31° C.

from 31° to 29° C. in 2 hrs from 29° to 25° C. in 40 hrs from 25° to 14° C. in 11 hrs from 14° to 13.5° C. in 5 hrs Three pressings were performed. The amounts of materials removed per pressing are shown in table I. After each removal the same amount of starting material was added to the crystalliser as liquid, at 13.5° C.

Pressing conditions were:

0–24 bar in 2 hrs (linear increase), followed by 1 hr at 24 bar. Presssing temperature in all experiments was the temperature in the crystalliser at the point in time when material was taken for pressing.

TABLE I

| | #1 | #2 | #3 |
|---|---|---|---|
| Time (h) | 0 | 21.5 | 45.5 |
| $S_C$ % | 23.3 | 22.2 | 25.7 |
| $S_E$ % | 29.0 | 29.0 | 29.0 |
| $\sigma$ | 0.20 | 0.23 | 0.11 |
| weight of slurry removed per pressing (g) | 455 | 457 | 452 |
| $\tau$ (over 3 pressings) h | | 300 | |
| Sep. Eff. in press % | 49.6 | 51.1 | 50.3 |
| Yield of stearin % | 47.5 | 53.4 | 54.2 |
| Quality of olein | | | |
| IV | 64.2 | 66.4 | 67.6 |
| N0 | 8.6 | 5.4 | 3.6 |

TABLE I-continued

| | #1 | #2 | #3 |
|---|---|---|---|
| Quality of stearin | | | |
| SOS | 52.0 | 50.9 | 52.0 |
| (40 h/20° C.) N20 | 47.6 | 47.1 | 49.3 |

Both olein and stearin are of good quality.

EXAMPLE 2

The stearin, obtained in example I was subjected to a dry factionation. The following conditions were applied:

volume crystalliser: 10 1 stirrer at 10 r.p.m.

cooling program:

1 hr at 70° C.

cooling from 70° to 30° C. in 4 hrs.

cooling from 30° to 27.2° C. in 4 hrs.

8 hrs. at 27.2° C.

cooling from 27.2° to 26.2° C. in 33 hrs.

Four pressings were performed. The amounts of materials removed and added per pressing are mentioned in table 2. The materials added had a temperature of 26.2° C.

Pressing conditions:

0–24 bar in 2 hrs.

1 hr at 24 bar

Press temperature in all experiments was the same as the temperature in the crystalliser at the point in time when material was taken for pressing.

TABLE 2

| | #1 | #2 | #3 | #4 |
|---|---|---|---|---|
| Time (h) | 0 | 24 | 48 | 72 |
| $S_C$ % | 18.4 | 19.2 | 19.0 | 18.0 |
| $S_E$ % | 21.1 | 21.1 | 21.1 | 21.1 |
| $\sigma$ | 0.13 | 0.09 | 0.10 | 0.15 |
| weight of slurry removed per pressing g | 358 | 388 | 368 | 346 |
| $\tau$ (over 4 pressings) h | | | 450 | |
| Sep. Eff. in press % | 42.6 | 43.9 | 44.2 | 43.1 |
| Yield of stearin | 58.1 | 54.1 | 53.3 | 54.0 |
| Quality of stearin | | | | |
| SOS % | 72.0 | 73.4 | 72.6 | 71.8 |
| (40 h/26°) N20 | 72.8 | 74.9 | 75.0 | 73.5 |
| Quality of olein SOO | 17.5 | 16.4 | 16.3 | 16.0 |

Both stearin and olein are of good quality.

EXAMPLE 3

Example 2 was repeated. However, the $\sigma$-value was adjusted to $\sigma$=0.73 by adding a sufficient amount of the fresh stearin having a temperature of 26.2° C. This was done by adding 1081 g of the fresh liquid stearin to 512 g of the oil #4 with $\sigma$=0.15. The product after pressing was not good. The above example was continued. However, the temperature in the crystalliser was adjusted to 23.0° C, resulting in an $S_c$ of 19.3% and a $\sigma$=0.09. The moment material was taken for the press is now the time =0. The resulting product after pressing was again not good, the reason being that although $\sigma$ was in the required range, the process time was less than 12 hours.

The results can be summarised as follows:

t=0 hour at the time we did the pressing with σ= ca 0.7

Temp. in crystalliser=26.2° C.

Pressing 0–24 bar in 2 hours + 1 hour at 24 bar.

Temperature in press was also 26.2° C.

t= 0 hour at the time we did the pressing with σ =ca 0.1

Temp. in crystalliser =23.0 °C.

Pressing 0–24 bar in 2 hours + 1 hour at 24 bar. Temperature in the press was also 23.0° C.

TABLE 3

| | #1 | #2 |
|---|---|---|
| time (h) | 0 | 0 |
| $S_C$ % | 5.8 | 19.3 |
| $S_E$ % | 21.1 | 21.1 |
| σ | 0.73 | 0.09 |
| weight of slurry removed g | 416 | 360 |
| τ h | 7.5 (3 liter crystalliser) | 28 (10 liter crystalliser) |
| Sep. Eff. in press % | 18.9 | 38.2 |
| Yield of stearin % | 59.1 | 78.5 |
| Quality of stearin | | |
| SOS | 62.9 | 64.0 |
| 40 h/26° C. N20 | 58.1 | 59.6 |
| Quality of olein SOO | 12.6 | 16.3 |

In both pressings the quality of stearin is not good. (SOS-levels and $N_{20}$ are too low.).

EXAMPLE 4

A palm oil stearin with:

IV=31.8

Slip melting point= 51.3° C.

SSS=33.3% was fractionated

Experimental details:

Volume crystalliser: 3 liter

Stirrer at 10 rpm

Cooling programme: 1 hour at 70° C.

Cooling from 70→52 in 1 h

Cooling from 52→42 ° C. in 10 h

Four pressings were done. The amounts of material removed and added per pressing are shown in the table 4. The materials added as liquid had a temperature of 50° C., because for else the palm oil stearin is not liquid. Pressing : 0–24 bar in 1 hour, followed by 30 minutes at 24 bar. Temperature of pressing was 42° C.

TABLE 4

| | #1 | #2 | #3 | #4 |
|---|---|---|---|---|
| Time (h) | 0 | 24 | 48 | 120 |
| $S_C$ | 14.1 | 14.8 | 15.2 | 15.9 |
| $S_E$ | 14.7 | 14.7 | 14.7 | 14.7 |
| σ | 0.04 | −0.01 | −0.03 | −0.08 |
| weight of slurry removed per pressing g | 131 | 130 | 139 | 157 |
| τ (Over 4 pressinqs) h | | | 560 | |

TABLE 4-continued

| | #1 | #2 | #3 | #4 |
|---|---|---|---|---|
| Sep. Eff. in press | 68.0 | 66.8 | 67.4 | 66.5 |
| Yield of stearin | 34.4 | 34.6 | 34.7 | 33.8 |
| quality of stearin: | | | | |
| C16 | 82.9 | 82.6 | 82.5 | 82.1 |
| IV | 10.8 | 9.6 | 9.9 | 10.1 |
| mpt | 59.8 | 59.6 | 59.6 | 59.1 |
| quality of olein: SOO | 14.6 | 14.3 | 14.3 | 13.9 |

Both stearin and olein are of good quality.

EXAMPLE 5

Hardened soybean oil, m.pt 39° C. was fractionated into 2 fractions (a top-fraction A and an olein-fraction B). The hardened soybean oil had the following N-values:

$N_{20}$=68.6

$N_{30}$=30.6

$N_{35}$=10.9

Experimental details:

Volume crystalliser: 10 liter stirrer at 10 rpm

Cooling programme: 1 hour at 70° C.

Cooling from: 70→40° in 5 hours

Cooling from: 40→33° in 7 hours

The final temperature is decided by the quality of top fraction A.

Three pressings were done. The amounts of material removed and added per pressing are shown in the table 5. The materials added as liquid had a temperature of 40° C. in order to ensure pourability. Pressing: 0–24 bars in 2 hours+ 1 hour at 24 bar. Press temperature: 33° C.

TABLE 5

| | #1 | #2 | #3 |
|---|---|---|---|
| Time (h) | 0 | 24 | 44 |
| $S_C$ | 13.3 | 12.6 | 14.1 |
| $S_E$ | 13.3 | 13.3 | 13.3 |
| σ | 0 | 0.05 | −0.06 |
| weight of slurry removed per pressing g | 469 | 505 | 453 |
| τ (over 4 press.) h | | 290 | |
| Sep. Eff. in press | 76.4 | 71.2 | 70.0 |
| Yield of A | 20.5 | 22.2 | 24.7 |
| Quality A: | | | |
| $N_{35}$ | 75.1 | 72.8 | 69.5 |
| slippoint | 46.7 | 45.0 | 44.7 |
| Quality of olein B: $N_{20}$–$N_{35}$ | 53.3 | 53.1 | 51.4 |

Both A and B are of good quality.

EXAMPLE 6

A palm olein-fraction, with the following analytical data, was fractionated:

IV=57.5

SOS=33.5%

$N_{20}$=3.9%

Experimental details:

Volume crystalliser: 220 liter, 200 kg slurry present stirrer speed: 4 rpm cooling programme:

1 hour at 60° C.

from 60 to 30 in 5 h from 30 to 25 in 10 h from 25 to 20 in 20 h from 20 to 15 in 10 h 12 h at 15° C.

from 15 to 14.4 in 5 h

Five pressings were done. The amounts of material removed per pressing are shown in the table below. After each removal the same amount of material was added to the crystalliser as a liquid at 14.4° C.

The volume of the press is variable between 10 and 50 liter. The press is of the membrane filterpress type.

Pressing profiles

Pressings 1, 2 and 3 : 0–20 bar in 50 minutes (linear increase) followed by 10 minutes at 20 bar Pressings 4 and 5: 0–24 bar in 50 minutes (linear increase) followed by 10 minutes at 24 bar Pressing temperature in all 5 pressings was the same as the temperature in the crystalliser at the point in time when material was taken for the pressing. In this experiment: 14.4° C.

| | #1 | #2 | #3 | #4 | #5 |
|---|---|---|---|---|---|
| Time (h) | 0 | 4 | 24.5 | 28.5 | 46.5 |
| $S_C$ % | 24.7 | 22.6 | 22.4 | 19.8 | 21.7 |
| $S_E$ % | 21.8 | 21.8 | 21.8 | 21.8 | 21.8 |
| σ | −0.13 | −0.04 | −0.03 | 0.09 | 0.005 |
| weight of slurry removed/pressing kg | 16.7 | 21.7 | 11.2 | 11.7 | 13.8 |
| τ over 5 pressings h | | | 3 | | |
| Sep. Eff. of Press % | 49.7 | 49.4 | 45.0 | 44.7 | 44.9 |
| Yield of stearin % | 45.8 | 41.4 | 52.0 | 53.5 | 50.9 |
| Quality olein | | | | | |
| IV | 65.5 | 63.9 | 64.9 | 63.6 | 67.4 |
| N0 | 8.4 | 12.0 | 9.0 | 11.0 | 7.0 |
| Stearin | | | | | |
| SOS | 49.0 | 50.8 | 47.7 | 45.8 | 51.5 |
| (40 h/20° C. $N_{20}$ | 49.9 | 54.1 | 43.9 | 46.4 | 46.7 |

Both olein and stearin are of acceptable quality.

We claim:

1. A process for the crystallisation of polymorphic fat molecules in a pseudo-steady state process, wherein the crystallisation is performed in a dry fractionation system by selecting and adjusting the flow rate, shear rate and temperature in such a way that the crystal form of the product is a kinetically-stable crystal form, while during the crystallisation a σ-value is maintained below 0.5, during a period of at least 12 hrs, wherein:

$$\sigma = 1 - \frac{S_c}{S_E}$$

$S_c$ being: percentage of solids in crystalliser at crystallisation temperature;

$S_E$ being: percentage of solids after stabilisation for 48 hours at exit temperature of the crystalliser.

2. Process according to claim 1, wherein the process is performed in a pseudo-steady state for at least 24 hours.

3. Process according to claim 1, wherein the residence time τ of the fat in the crystalliser is more than 1 hour τ being defined as:

$$\tau = \frac{\text{Volume of crystalliser}}{\text{Average flow rate}}$$

4. Process according to claim 1, wherein a crystalliser is applied whose volume is more than 2 times the volume of the separator applied.

5. Process according to claim 4, wherein the volume of the crystalliser is more than 10 $m^3$, more preferably more than 60 $m^3$.

6. Process according to claim 1, wherein the fat is selected from the group consisting of palm oil, palm oil olein, shea, high-oleic sunflower oil, palm oil stearin, high stearic bean oil, hardened vegetable fat, enzymically interesterified fats, chemically interesterified fats and mixtures thereof.

7. Process according to claim 1 wherein the σ-value is maintained below 0.3 during a period of at least 12 hours.

8. Process according to claim 1 wherein the σ-value is maintained between 0.001 and 0.2 during a period of at least 12 hours.

9. Process according to claim 2 wherein the process is performed in a pseudo-steady state for at least 48 hours.

10. Process according to claim 2 wherein the process is performed in a pseudo-steady state for at least 60 hours.

11. Process according to claim 4 wherein the crystalliser volume is more than 3 times the volume of the separator.

12. Process according to claim 4 wherein the crystalliser volume is more than 5 times the volume of the separator.

13. Process according to claim 5 wherein the volume of the crystalliser is more than 30 $m^3$.

14. Process according to claim 5 wherein the volume of the crystalliser is more than 60 $m^3$.

* * * * *